US008888209B2

(12) United States Patent
Pouzet

(10) Patent No.: US 8,888,209 B2
(45) Date of Patent: Nov. 18, 2014

(54) SYSTEM FOR DETERMINING THE AUTONOMY IN CONSUMABLE FLUIDS OF A CONTINUOUS INK JET PRINTER

(75) Inventor: Sébastien Pouzet, Saint Fortunat sur Eyrieux (FR)

(73) Assignee: Markem-Imaje, Bourg-les-Valence (FR)

( * ) Notice: Subject to any disclaimer, the term of this patent is extended or adjusted under 35 U.S.C. 154(b) by 137 days.

(21) Appl. No.: 13/518,858

(22) PCT Filed: Dec. 21, 2010

(86) PCT No.: PCT/EP2010/070413

§ 371 (c)(1), (2), (4) Date: Aug. 29, 2012

(87) PCT Pub. No.: WO2011/076808

PCT Pub. Date: Jun. 30, 2011

(65) Prior Publication Data

US 2012/0327145 A1 Dec. 27, 2012

(30) Foreign Application Priority Data

Dec. 23, 2009 (FR) ..... 09 59501

(51) Int. Cl.

| | |
|---|---|
| ***B41J 2/195*** | (2006.01) |
| ***B41J 2/175*** | (2006.01) |
| ***B41J 2/185*** | (2006.01) |
| ***B41J 2/02*** | (2006.01) |

(52) U.S. Cl.

CPC ..... *B41J 2/17566* (2013.01); *B41J 2/175* (2013.01); *B41J 2/185* (2013.01); *B41J 2/02* (2013.01)

USPC ..... 347/7; 347/85

(58) Field of Classification Search

CPC ..... B41J 2/17566; B41J 2/04571; B41J 2002/17566; B41J 2002/17569; B41J 2002/17589

USPC ..... 347/5–7, 84–86

See application file for complete search history.

(56) References Cited

U.S. PATENT DOCUMENTS

| | | | | |
|---|---|---|---|---|
| 4,432,005 | A * | 2/1984 | Duffield et al. | 347/86 |
| 4,827,278 | A | 5/1989 | Lecheheb | |
| 4,862,192 | A | 8/1989 | Slomianny | |
| 5,160,939 | A | 11/1992 | Bajeux et al. | |

(Continued)

FOREIGN PATENT DOCUMENTS

| | | | |
|---|---|---|---|
| CN | 1201142 | A | 12/1998 |
| CN | 1235904 | A | 11/1999 |

(Continued)

OTHER PUBLICATIONS

International Search Report issued Mar. 15, 2011, in International Application No. PCT/EP2010/070416.

(Continued)

*Primary Examiner* — Stephen Meier
*Assistant Examiner* — Sharon A Polk
(74) *Attorney, Agent, or Firm* — Miles & Stockbridge P.C.

(57) ABSTRACT

A system for determining the autonomy in consumable fluids (ink and solvent) of a continuous inkjet printer, including a system for measuring the total volume of available ink, a system for determining the average ink consumption, the ink autonomy (AE) by division of the volume of ink with the average ink consumption.

12 Claims, 5 Drawing Sheets

(56) References Cited

U.S. PATENT DOCUMENTS

| | | | | |
|---|---|---|---|---|
| 6,082,851 | A * | 7/2000 | Shihoh et al. | 347/85 |
| 6,151,039 | A | 11/2000 | Hmelar et al. | |
| 6,352,324 | B1 | 3/2002 | Pagnon et al. | |
| 6,793,305 | B2 | 9/2004 | Tsukada et al. | |
| 7,013,804 | B2 | 3/2006 | Chelvayohan | |
| 2003/0071862 | A1 | 4/2003 | Tsukada et al. | |
| 2005/0128230 | A1 | 6/2005 | Chelvayohan | |
| 2006/0290723 | A1 | 12/2006 | Jeong | |
| 2008/0100660 | A1 | 5/2008 | Perrin et al. | |

FOREIGN PATENT DOCUMENTS

| | | | |
|---|---|---|---|
| CN | 1380852 | A | 11/2002 |
| CN | 1883952 | A | 12/2006 |
| CN | 101253047 | A | 8/2008 |
| CN | 101437686 | A | 5/2009 |
| DE | 1816856 | A1 | 7/1970 |
| EP | 0 362 101 | B1 | 11/1993 |
| EP | 0 882 595 | A2 | 12/1998 |
| EP | 0 916 502 | A | 5/1999 |
| EP | 1 285 764 | A1 | 2/2003 |
| EP | 0 968 831 | B1 | 6/2003 |
| FR | 2879961 | A1 | 6/2006 |
| JP | 2001-071532 | A | 3/2001 |
| WO | WO 88/04235 | | 6/1988 |
| WO | WO 2007/129110 | A2 | 11/2007 |
| WO | WO 2009/047497 | A2 | 4/2009 |

OTHER PUBLICATIONS

International Search Report issued Mar. 16, 2011, in International Application No. PCT/EP2010/070413.

Chinese Office Action issued Apr. 28, 2014, in Chinese Application No. 2010800636144 with English Translation.

Notice of Allowance issued Jun. 25, 2014, in U.S. Appl. No. 13/518,800.

Chinese Office Action issued May 4, 2014, in Chinese Application No. 2010800646875 with English Translation.

* cited by examiner

SYSTEM FOR DETERMINING THE AUTONOMY IN CONSUMABLE FLUIDS OF A CONTINUOUS INK JET PRINTER

TECHNICAL FIELD

The invention concerns a system for determining the consumable fluid autonomy of a continuous ink jet printer.

The invention pertains to the determination of both the ink and solvent autonomy of a continuous ink jet printer.

In other words, the invention makes it possible to precisely manage reserves of consumables which are the ink and solvent in a continuous ink jet printer. Precise management of consumables thus allows an operator in charge of the production of printing products using continuous ink jet printers to achieve optimal management of the production of said products and of the maintenance operations to be performed on said printer.

BACKGROUND OF THE INVENTION

Continuous ink jet printers are well known in the field of coding and industrial marking of various products, for example to mark barcodes or the expiration date on food products directly on the production line and at a high speed rate. This type of printer is also found in certain decorative fields where the graphic printing possibilities of the technology are exploited.

It is traditionally distinguished two categories within continuous ink jet printers:

- on one hand, multi-deflection continuous jet printers where each drop of a single jet (or few jets) can be sent on various paths corresponding to controls for different deflections of the drops, thereby achieving raster scans of the zone to be printed following a scan direction which is the deflection direction;
- on the other hand, binary continuous jet printers where a plurality of jets placed side by side each have only one drop path designed for printing; the synchronous control, at a given moment, of all of the jets makes it possible to print on the medium according to a pattern corresponding in general to that of the nozzles on the nozzle plate.

In both types of printers, the other direction perpendicular to scan raster of the zone to be printed is covered by relative movement between the printing head and the medium to be printed.

As illustrated in FIG. 1, these printers include a printing head, generally distant from the body of the printer; it is connected thereto by an umbilical bringing the hydraulic and electrical feeds necessary for the operation of the head.

The head 101 has a drop generator 102 supplied with pressurized electrically conductive ink and capable of emitting one or several continuous jets 109 through calibrated nozzles 105, the jets being transformed into a succession of drops under the action of a periodic stimulation system situated upstream from the nozzle(s), from a point called the "break up point" 106 where the drops are formed.

When the drops are not intended for printing, they are directed toward a gutter 103 which recovers them and returns them toward an ink circuit 100 in order for the ink to be recycled.

Devices placed along the jet (charge 107 and deflection 104 electrodes) make it possible, upon command, to electrically charge and deflect the drops; these drops are deviated from their natural ejection trajectory from the drop generator.

The drops 108 intended for printing escape the gutter and are deposited on the medium to be printed. More specifically, a charge electrode 107 is designed to selectively charge each of the drops formed with a predetermined electrical charge value. To do this, the ink being kept at a fixed electrical potential in the drop generator, a determined voltage is applied to the charge electrode 107 which is different at each period of drop formation. Thus, by electrostatic effect, a determined quantity of electrical charges is taken on by each drop at the moment when it detaches from the jet. Downstream from the charge electrode 107, it is advantageously possible to provide a device making it possible to measure the electrical charge actually taken on by each drop as well as its speed in the head.

A set of deflection electrodes 104, in the form of plates, is placed on either side of the trajectory of the drops downstream from the charge electrode 107. These two plates are brought to a high fixed relative potential producing an electrical field Ed essentially perpendicular to the trajectory of the drops, capable of deflecting the electrically charged drops which engage between the plates 104.

The amplitude of the deflection depends on the charge and the speed of these drops. These deflected trajectories 108 escape the gutter 103 in order to impact the medium to be printed.

Ink jet printers also comprise a fluid circuit 100 which performs the two basic functions, i.e. providing ink to the drop generator 102 at a suitable pressure and with a suitable quality, and recovering, by suction, the ink not used for printing from the jets. The fluid circuit 100 is connected on one hand to a removable ink cartridge 30 and on the other hand to a removable solvent cartridge 40, the solvent making it possible to adjust the viscosity and/or concentration of the ink intended for printing.

Ink jet printers also comprise a controller 200. This controller 200 interacts on one hand directly with the drop generator 102 and the charge electrodes 107 in order to stimulate the inkjet and manage the printing sequencings, and on the other hand with the fluid circuit 100, in order to manage the action sequencings and perform the processing enabling the activation of the different functions of the fluid circuit 100. The printing sequencings consist of generating the succession of voltages synchronized with the formation of drops making it possible to charge each of the drops according to the pattern to be printed. The action sequencings of the fluid circuit consist of controlling the ink pressure in order to adjust the speed of the drops, carrying out the measurements on the sensors, driving the active components (solenoid valves, pump motors).

The controller is also connected with the production line of the goods to be printed, which provides it with the temporal information allowing it to synchronize the printing of messages with the passage of the products under the head. This information allows it to measure the linear speed and the throughput rate of each production line.

Inkjet printers lastly comprise an interface 300 interacting with the controller 200 which gives the user (operator) a means to drive the printer and in return to be informed of the operation thereof. Depending on the different technologies used over time, the interfaces have been able to assume different forms such as, for example, having control buttons or keyboards, indicator lights, displays or screens which are more or less sophisticated, and, possibly, electrical or computer connections allowing remote control of the printer. This being the case, the interface 300 of the printer allows the final user (operator) to have several differentiated operating modes, in particular:

a maintenance mode making it possible to physically put the printer in its condition to print, but without carrying out the production;

a production preparation mode making it possible to generate the data to print and configure the printing to be done for production;

a production printing mode where the state of the printer and the production monitoring are shown while the data (pattern) is printed on demand (from the production line or signals internal to the printer).

During the production of products, any untimely stopping of a continuous production line, in particular in a line at a high rate, is very detrimental (loss of exploitation, discarding of non-compliant products). Thus, preventive maintenance of parts or sub-assemblies of the line is provided to avoid any untimely stops.

One can consider that the untimely stops of one or several continuous inkjet printers integrated in a continuous production line are due mainly to the degradation of the printing quality and the exhaustion of one of the consumable fluids (ink or solvent). Indeed, stops due to operational breakdowns are rare as they can often be avoided by preventive maintenance of the printer.

The degradation of the printing quality, to the point of becoming unacceptable, is caused mainly by the progressive dirtying of the printing head.

In order to minimize or delay dirtying of the head in continuous inkjet printers, it is known to perform on one hand, a continuous pressurization of the inside of the head and on the other hand, preventive interventions such as cleaning of all or part of the components of the head (drop generator, nozzle, charge electrodes, deflection electrodes and gutter) and making optimal adjustments thereof.

Exhaustion of the consumable fluids generally leads to automatically stopping of the concerned printer by itself. Indeed, in the contrary case, either the printing head could ingest air in case of the absence of ink entering from the supply pump, or the jet(s) emitted by the head could no longer be controlled due to the deterioration of the ink quality which would no longer be controlled due to the lack of solvent. Thus, not stopping the printer under these conditions would require a long intervention to return the printer to its condition to print correctly, which would thereby penalize the availability of the continuous production line.

Thus, many continuous inkjet printers according to the prior art implement solutions to anticipate the exhaustion of the consumable fluids (ink and solvent).

By inventorying commercial solutions and solutions described in the literature, the inventors came to the conclusion that there are, to date, two categories of solutions for anticipating the exhaustion of consumable fluids (ink and solvent) in a continuous inkjet printer:

1/the possibility for the user (operator) of being able to resupply the printer with consumables during production, either by replacing removable cartridges or by filling fixed tanks inside the printer from transfer containers at the disposal of the user;

2/indicators, as components of the user interface, of the level or volume of consumable fluids remaining in the printer indicating the approach of the exhaustion of the consumables. These indicators are connected in input to systems for determining the quantity of ink and/or solvent and are often connected at their output to alarms, other components of the user interface, triggered to warn the user of an exhaustion threshold. Therefore, at best, the user, notified by the interface of the printer, can resupply the printer during production. The user interfaces according to the prior art have as components, alarms for detecting overly high levels and/or indicators of evaluated volumes of consumables in the form of a proportion (percentage) relative to the initial contents of the tanks.

The systems for determining the quantity of ink and/or solvent used in the inkjet printers according to the prior art implement solutions consisting of detecting levels of fluids in the tanks.

One of the most reliable and easiest to implement, which is used for example in Series S8 type printers by the company Imaje, uses the principle of rod level sensors dipping into the tank: the fluid resistivity is measured between two rod level sensors, and if the ink short circuits the rods, the drop in resistivity is detected to declare a presence of ink at that level.

This system remains, however, costly due to the electronic protections which the standards require be implemented when electrical currents pass in flammable environments or fluids, which is in general the case of ink with volatile solvent. It must be noted that this type of detector by rod level sensor cannot be used with insulating fluids as solvents generally are. The solvent level is then not really detected and it is only through the degradation of the ink quality for lack of solvent that the printer notifies the user of the exhaustion of the solvent. There are, of course, other devices known by those skilled in the art making it possible to detect a fluid level such as capacitive, optical or other sensors, but the device must be explosion-proof given the flammable nature of the fluids used.

One can also cite the solution disclosed in application WO2009/047497 by the company Videojet which consists of evaluating the quantity of fluid remaining in a removable semi-rigid sealed cartridge.

The measuring system includes means for measuring the level of the vacuum created by the withdrawal of the consumable fluid which progressively deforms the cartridge, this vacuum value being representative of the quantity of remaining fluid. This measurement can only be approximate and concerns only the fluids contained in cartridges of new consumable fluids, i.e. which are not present in the ink circuit itself.

One can also cite the solution disclosed in application WO2007/129110 by the company Domino, which consists of determining the quantity of consumables remaining from the initial quantity of the reserves and a continuous evaluation of the fluid consumption. Thus, for the solvent, the number of doses of solvent used to correct the viscosity of the ink or for cleaning is counted. For ink, the number of printed positions of drops is counted, from the decomposition of patterns to be printed messages and characters). These volume evaluations are very imprecise because the volumes of the doses of solvent or drops of ink printed are not known with sufficient precision (and can also vary, depending on external conditions), and likewise the number of drops actually printed is not precisely known.

Thus, although many solutions for anticipating the exhaustion of consumable fluids (ink and solvent) exist in the prior art, the situation remains imperfect and restrictive for a user (operator) of continuous inkjet printers in an industrial setting. Indeed:

the continuous inkjet printers of the prior art do not offer the possibility of precisely determining the autonomy in consumable fluids: indeed, they do not have systems for precisely measuring the quantity of consumable fluids (ink and solvent) still available, or systems for precisely measuring the actual consumption of consumable fluids in a given production sequence;

the user (operator) interface of the printer does not provide the best information to facilitate management of consumables by the user: the indication of a discrete level or a volume of consumable in the form of a percentage of an initial capacity does not allow him to easily determine whether this quantity will be sufficient for a given production duration or quantity of products to be marked in light of the preceding, i.e. the imprecise measurement of the quantity of consumable fluids and the actual consumption of the consumable fluids in a given production sequence. It is therefore essential for the operator to dedicate part of his attention to regularly monitoring the printer's level of consumables;

furthermore, the operator of a production line is not necessarily available to take care of the printer when the alarms are triggered. An alarm is therefore intrusive and can lead to a stressful situation generating errors;

the alarms are triggered, in general with a safety margin corresponding to a minimal volume of consumable material still available; either the operator has the time to resupply the printer right away at the risk of wasting consumable product, which is often costly, as the cartridges to be changed are not completely empty yet, or he must monitor the evolution of the ink and/or solvent consumption for subsequent intervention when the cartridge(s) is/are completely empty.

An object of the invention is therefore to overcome all or some of the aforementioned drawbacks.

One aim of the invention is therefore to propose a system for determining the autonomy in fluids (ink or solvent) of a continuous inkjet printer which is precise.

BRIEF DESCRIPTION OF THE INVENTION

To this end, the invention provides a system for determining the autonomy in consumable fluids of a continuous inkjet printer provided with a printing head comprising:

a system for measuring the quantity of ink comprising:

a removable ink cartridge, a first tank, of section S1 known over its entire height and adapted to be filled with ink and to supply the printing head with this pressurized ink and respectively recover the fluids coming from the head and not used for printing, a second tank, of section S2 known over its entire height and the bottom of which is hydraulically connected with the bottom of the first tank by a first hydraulic line comprising a first valve with complete closing, the second tank comprising a continuous level sensor adapted to continuously detect the height of a liquid over the entire height of the measuring tank, the inside of the first and second tanks being at the same gas pressure, means for establishing a forced hydraulic connection in ink respectively from the removable ink cartridge and the second tank toward the first tank in order to completely empty the second tank and the ink cartridge, control means adapted to perform the opening of the first valve, once the complete emptying into the second tank is done, in order to establish filling of identical height H by communicating vessel between the first and second tanks, calculating means adapted to determine the total volume of ink ($V_E$) contained in the first tank and in the second tank from the detection of the identical height by the continuous level sensor and the sections S1 and S2, a system for determining the average ink consumption comprising:

means for determining the volume of a drop coming from a jet emitted by the head;

an electronic counter connected to the charge electrode of the head to count, in comparison with the charge voltage applied to the charge electrode, the number of drops deflected by the deflecting electrodes of the head;

digital means for accumulating the values counted by the counter over a period of time T;

calculating means to determining the average ink consumption (Cme) by multiplying the number of drops counted over the period of time T and the volume of a drop;

calculating means for determining the autonomy in ink (AE) by division of the volume of ink with the average ink consumption.

The measuring system used according to the invention is that described in U.S. patent application Publication No. 2012/0299989 entitled "measuring system in a fluid circuit of a continuous inkjet printer, related fluid circuit and block designed to implement same" and filed today in the name of the company Markem-Imaje. The entire content of this application is incorporated by reference in the present document.

The measuring system according to the invention can comprise:

a third tank, of section S3 known over its entire height, the third tank being connected to the first tank by a second hydraulic line making it possible to establish a forced hydraulic connection from the first toward the third tank and comprising a second valve with complete closing, the bottom of the third tank being in continuous hydraulic connection with the bottom of the second tank by a third hydraulic line comprising a calibrated hydraulic restrictor, the third tank also being arranged to be able to overflow over the first tank;

means for establishing a forced hydraulic connection from the first toward the third tank.

The control means are thus adapted to successively realize the opening of the second valve during a forced hydraulic connection from the first toward the third tank until a constant level is established in the latter by overflowing into the first tank and the complete closing of the second valve, once the second tank has been completely emptied and the constant level is established in the third tank, in order to establish on one hand complete filling of identical height by communicating vessel between the first, second and third tanks, and on the other hand, a flow of ink at a constant pressure through the calibrated hydraulic restrictor, and the calculating means of the measuring system are adapted on one hand to determine the volume of ink contained in the three tanks from the detection of the identical height H by the continuous level sensor and the sections S1, S2 and S3 and on the other hand the viscosity μ of the ink, from the evolution, over time, of the level measured by the continuous level sensor when the ink at constant pressure flows through the calibrated hydraulic restrictor, the measuring system thereby also constituting a viscometer of the ink for printing.

The measuring system can also comprise:

a fourth tank, of section S4 known over its height adapted to be filled with solvent, means for establishing a forced hydraulic communication from the fourth tank toward the second tank in order to bring the solvent therein.

The calculating means of the measuring system are also adapted to determine the height h' of solvent to be brought into the second tank from the knowledge of a calculated viscosity μ of the ink.

The control means of the measuring system are adapted to interrupt the arrival of solvent in the second tank by forced hydraulic connection, once the height h' is detected by the continuous level sensor.

The determining system also comprises:

calculating means to determine the average solvent consumption (Cms) by accumulation, over a period of time T', of the volumes of solvent to correct the viscosity of the ink obtained by multiplying the height h' of the solvent brought onto the section S2 of the second tank and by dividing these volumes of solvent accumulated during the period T', calculating means for determining the autonomy in solvent (AS) by division of the volume of solvent (Vs) contained in the fourth tank with the average solvent consumption (Cms).

Advantageously, the control means, calculating means, counter and accumulation means of the counter are integrated into a same controller.

The invention also concerns a continuous inkjet printer implementing a system for determining the autonomy in consumable fluids previously described, comprising a user interface adapted to visually display both the ink autonomy (AE) and solvent autonomy (AS) in number of printing hours or in number of remaining products to be printed for given printing conditions.

The invention makes it possible to provide the user of a continuous inkjet printer with synthetic, precise and real-time information on the duration of printing or the number of products still possible to print (or printing autonomy) with the quantities of consumables available in the printer at a given moment. The number of products to be printed is connected to the printing duration by the rate of the production line in number of products per unit of time. The printing autonomy is determined based on a precise determination of the remaining quantity of consumables in the printer and a real measurement of the consumption over a sliding period of fixed duration. The autonomy in consumables (ink and solvent) can be continuously displayed on a screen as a component of a user interface of the printer, and in number of hours of use or in number of products to print for the ink and solvent.

BRIEF DESCRIPTION OF THE DRAWINGS

Other advantages and characteristics will better emerge upon reading the detailed description of the invention, made as an illustration and non limitative, in reference to the following figures among which.

DETAILED DESCRIPTION OF THE INVENTION

Figure 1:
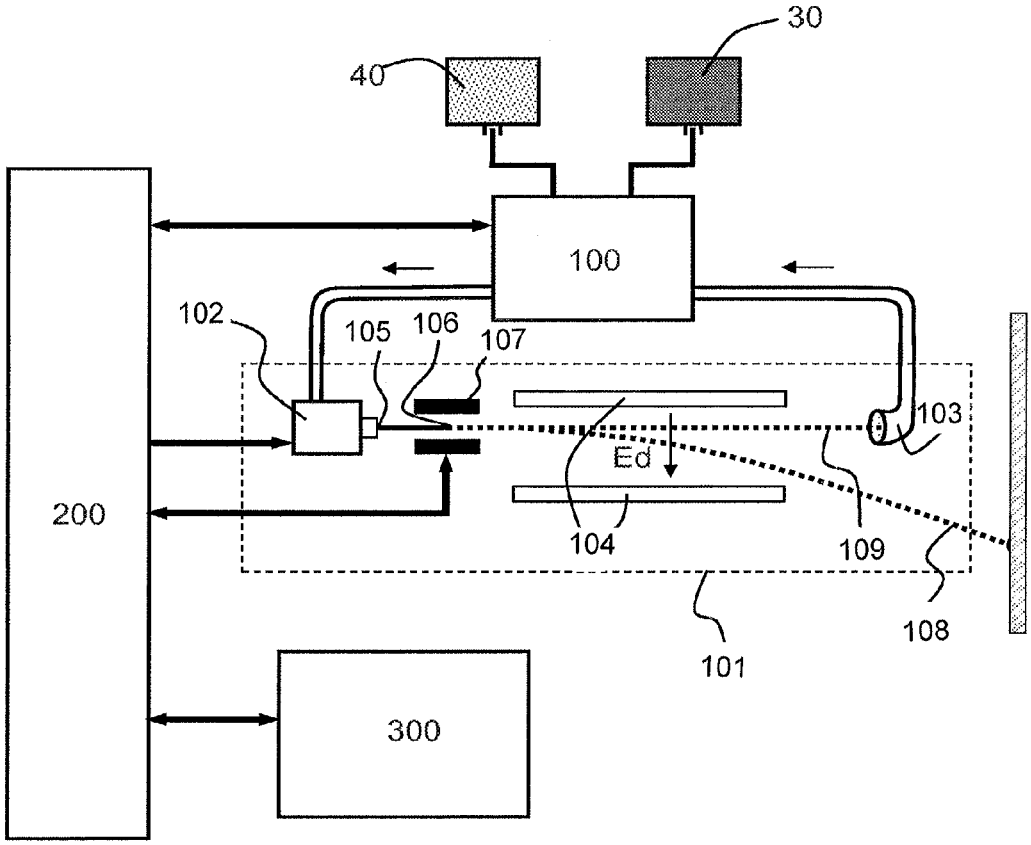
FIG. 1 is a schematic diagram of the operation of a continuous inkjet printer.
Figure 2:
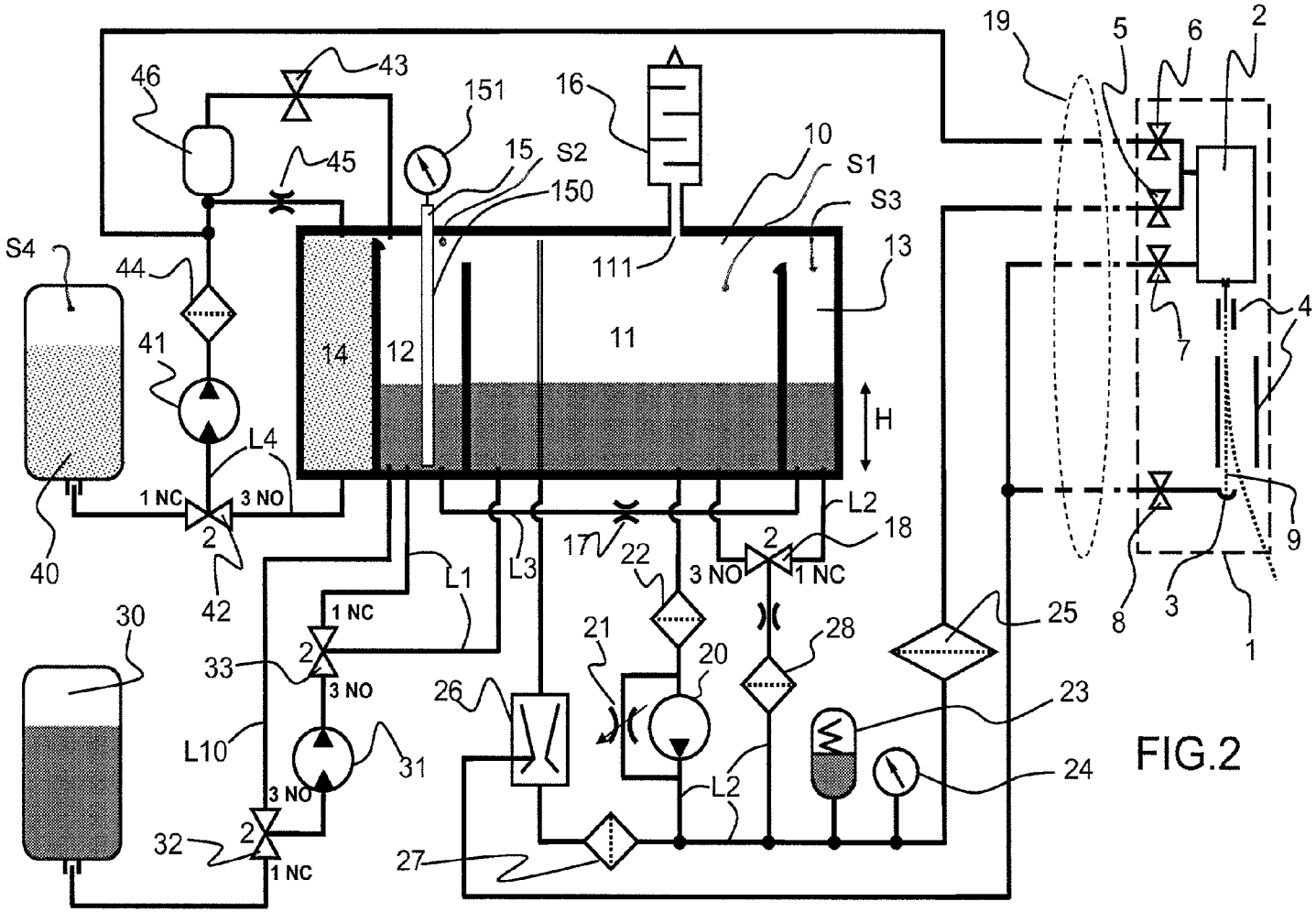
FIG. 2 is a hydraulic diagram of the continuous inkjet printer fluid circuit implementing the measuring system according to the invention.

FIG. 2 shows a hydraulic diagram of the fluid circuit according to the invention, of a multi-deflected continuous inkjet printer with its printing head 1.

The head 1 comprises a drop generator 2 and a recovery gutter 3. It integrates four solenoid valves 5, 6, 7, 8 each connected to one of the four hydraulic conduits entering the head through the umbilical 19.

The ink-head solenoid valve 5 allows, in the open position, the supply of the drop generator 2 with pressurized ink.

The solvent-head solenoid valve 6 allows, in the open position, the supply of the drop generator 2 with pressurized solvent.

The purge solenoid valve 7 allows, in the open position, during certain maintenance operations, connection of the drop generator 2 to a vacuum source.

The gutter solenoid valve 8 allows, in the closed position, isolation of the gutter 3 when no jet 9 of ink is emitted by the drop generator. This prohibits air from entering when the jet 9 is not emitted in order to minimize the evaporation of the solvent in the fluid circuit.

The gutter 3 is permanently connected in printing operation (solenoid valve 8 open), through the umbilical 19, to a vacuum source situated in the fluid circuit.

The maintenance operations of the head are done by specific sequencings of openings and closings of these solenoid valves controlled by a controller of the printer not shown in FIG. 2.

This controller integrates all of the control and calculating means according to the invention. The sequencings enable the implementation of functions of the fluid circuit described below.

We will now describe how the basic functions (supply of pressurized ink to the head 1, suction of fluids returning from the head) are done in the fluid circuit according to the invention.

Regarding the supply of pressurized ink, the ink intended for the head 1 is drawn in an intermediate tank 11. Such a tank can be qualified here and in the context of the invention as intermediate because it constitutes a storage-buffer tank in which the ink is stored in a part of the fluid circuit which is intermediate between the ink 30 and solvent 40 cartridges (removable consumables cartridges) and the printing head 1 strictly speaking. The fluids returning from the head are recovered by this same intermediate tank 11.

The ink contained in the tank 11 is maintained with the required quality for optimal printing operation, in particular adjusted in viscosity, as described below using the system according to the invention.

After being crudely filtered by the filter-grid 22, the ink withdrawn in the intermediate tank 11 arrives at the inlet of the gear pump 20 which pressurizes it.

This pump 20 is driven by a motor controlled in speed (power) by the controller. The pump 20 can be hydraulically bypassed by an adjustable bypass 21 in order to adjust its operating range (pressure/flow or pressure/speed of rotation characteristic). At the outlet of the gear pump 20, the average pressure undergoes an undulation the frequency of which is related to the speed of rotation and the number of teeth of the gears.

This undulation can disrupt the ejection speed of the drops which depends directly on the pressure of the ink and as a result also influences the deflection amplitude of the drops during printing, which would degrade the marking quality. This is why an anti-pulse device 23 is advantageously provided downstream from the pump 20.

This anti-pulse device 23 is preferably consisting of a deformable resilient envelope containing a volume of gas and submerged in the pressurized ink, which makes it possible to damp these undulations at the outlet of the pump 20.

The characteristics of the anti-pulse device 23 are determined according to the average operating point of the pump.

A pressure sensor 24 is provided downstream from the anti-pulse device 23: its data is used by the controller to control the pressure of the ink according to a set point, generally when the inkjet speed in the head is not available (for example when the ejection of the jet is stopped, or the jet speed cannot be measured).

In jet speed control mode, as is the case when one wishes to print with good quality, the pressure sensor 24 is used as an indicator to monitor the operation of the printer. Moreover, one can provide a pressure sensor technology which makes it possible also to obtain the temperature of the ink, which is useful in managing the control of the ink viscosity.

The ink is lastly filtered by the main filter 25 downstream from the sensor 24 before being sent to the head 1.

The main filter 25 has the filtration grade and capacity making it possible to protect the nozzle during a very long period before the need for a maintenance intervention on the printer.

The fluids not used for printing are sucked at the head (recovered by the gutter or returning from purge) through the umbilical with the help of a hydro-ejector 26.

In the fluid circuit according to the invention, the hydro-ejector 26 uses part of the flow from the pump 20 as driving energy to create a vacuum by Venturi effect. In other words, the excess flow driven back by the pump 20 is used, after filtering by the filter grid 27, to bring the pressurized ink into the hydro-ejector 26 which thus creates the vacuum necessary to drive the fluids returning from the head 1 toward the intermediate tank 11.

The filter-grid 27 serves to protect the injector (fine restriction) of the hydro-ejector 26.

As is known, starting and stopping the jet are two delicate operations.

Their sequencing must be optimized to ensure proper and reliable start-ups of the jet even after long stops. In the circuit according to the invention, these operations generally unfold as follows:

- upon stopping of the jet, the jet is passed in solvent to clean the drop generator 2 and the nozzle, then the purge and gutter 3 circuits (including their solenoid valves 7 and 8) are rinsed and to finish the solvent is sucked from the drop generator 2 and the gutter 3 before closing all of the solenoid valves 5, 6, 7, 8 of the head;
- upon starting up of the jet, after opening the gutter 3, the drop generator 2 is supplied with pressurized solvent then, during a purge, the solenoid valve 5 is opened for some time before closing the solenoid valve 6: the jet passes progressively from the solvent to the ink without destabilizing. The sequencing of these operations must be watched to guarantee the stability of the jet during switches between fluids of different viscosities: the ink and solvent are supplied to the head with close pressure values and good stability of these pressures for both fluids.

We will now describe one embodiment of the measuring system according to the invention implemented in the illustrated fluid circuit.

The system comprises a single container 10 partially partitioned defining four functional tanks 11, 12, 13, 14 connected to each other and to two removable cartridges of reserve consumables (ink cartridge 30 and solvent cartridge 40) by conduits or passages and some active hydraulic components (controlled by the controller) such as four 3-way solenoid valves 18, 32, 33, 42, a 2-way solenoid valve 43 and two low-capacity diaphragm pumps 31, 41. The ink cartridge 30 and the solvent cartridge 40 make it possible to replace the fluids consumed by the printer during its operation. These cartridges do not have any of their own means for measuring or detecting the volume of fluid they contain. The cartridges connect to bases associated to the corresponding solenoid valves 32, 42.

More precisely, the sole container 10, the bottom of which is flat and horizontal, comprises internal partitions walls present on only a part of its height, dividing it into four tanks 11, 12, 13, 14 opening onto the height in a shared volume. The four tanks 11, 12, 13, 14 are therefore pressure balanced at an identical gaseous pressure.

The shared volume inside the container 10 is in communication with the outside air through a vent 111. Thanks to this vent, the air charged with solvent vapor from the driving back of the hydro-ejector 26 which sucks the fluids (mix of ink and air entering the gutter 3 of the printing head 1) is allowed to escape toward the outside.

Before reaching the open air, this solvent vapor-charged air passes through a passive condenser 16 constituted by a cavity provided with baffles which multiply the contact surface between the charged air and the walls of the condenser. Such a condenser 16 makes it possible to condense, on its walls, part of the vapors from the solvent which return by gravity into the intermediate tank 11. The air which escapes from the passive condenser 16 may pass through an active condenser (not shown in the figure) cooled by Peltier cell or other system known by one skilled in the art.

As explained below, according to the measuring functions of the system according to the invention (utility functions of the circuit), each tank 11, 12, 13, 14 is more or less filled with fluid. Because the separating partition walls are not realized up to the top of the container 10, a full tank can overflow into the adjacent tank. Thus, as explained below, the tank 13 is used as constant level tank by overflowing into the intermediate tank.

As previously explained, the intermediate tank 11 is that which contains the ink designed to be pressurized and to supply the printing head 1 and to recover the fluids coming from the return there from via the gutter 3. This tank 11 is that which has the largest contents, typically 1300 $cm^3$.

The second tank 12 is the measuring tank because it is therein that the measurements strictly speaking of the ink and solvent levels are done using a continuous level sensor 15 which equips it.

The third tank 13 is supplied, in closed circuit, with the ink coming from the intermediate tank 11 to constitute a constant level tank by overflow toward the intermediate tank 11. More precisely, the ink is pumped using the supply pump 20 from the intermediate tank 11 to the tank 13 by driving back through the filter-grid 28 and the solenoid valve 18 in position NC (1-2). Thus, filled at a constant level, the tank 13 supplies ink with a constant static pressure making it possible to perform a viscometer function which will be described later. The constant level tank 13 is in continuous hydraulic communication with the measuring chamber 12 using a conduit L3 connecting their bottom, provided with a calibrated hydraulic restrictor 17.

The fourth tank 14 constitutes a solvent tank serving for rinsing of the head during the start and stop operations of the jet.

This tank 14 also makes it possible to extend the operation of the printer when the solvent cartridge 40 is empty, by supplying the solvent necessary to correct viscosity and thereby provides the user with the possibility of deferring replacement of the empty cartridge. This tank 14 can overflow into the measuring tank 12.

In order to transfer ink or solvent to the intermediate tank 11, two sub-assemblies are provided each comprising a pump connected to two solenoid valves constituting a sub-assembly dedicated to the transfer of one of the fluids.

Thus for the transfer of ink, a sub-assembly comprises the pump 31 associated with the solenoid valves 32, 33. This makes it possible on one hand to transfer new ink from the cartridge 30 toward the intermediate tank 11 and on the other hand, to empty the measuring tank 12 toward the intermediate tank 11.

For the transfer of solvent, another sub-assembly comprises the pump 41 connected to the solenoid valves 42, 43. This makes it possible on one hand to transfer determined quantities of solvent toward the measuring tank 12, either from the solvent cartridge 40 toward the solvent tank 14 which will overflow toward the tank 12, or from the solvent tank 14 toward the measuring tank 12 and on the other hand, to pressurize the solvent, coming from the solvent tank 14, for rinsing of the head during stops and starts of the jet.

Thus, with the exception of the supply of solvent (hydraulic line L4) coming from the solvent transfer pump 41, the hydraulic lines L1, L2, L10, L3 connected to the container 10 are connected only at the level of its flat and horizontal bottom, which is that of the four tanks 11, 12, 13 and 14, which allows communications of fluid by communicating vessel used as explained below.

As indicated above, the sensor 15 is a continuous level sensor: it is therefore capable of measuring any level of fluid present in the measuring tank 12. Thus, the system can, by performing level measurements cyclically, know and exploit the evolution of the level over time. As shown, the continuous level sensor 15 is constituted by a pressure sensor 151 tightly connected to one end of a tube 150, the other end of the tube being open. The tube 150 is arranged vertically in the measuring tank 12 such that the opening of the tube opens near the bottom. There are, of course, other devices known by those skilled in the art making it possible to measure a continuous level such as ultrasound sensors, capacitive sensors or others. It is, however, necessary to watch that the device used is explosion-proof given the flammable nature of the fluids used (ink, solvent).

The pressure sensor 151 measures the static pressure Pstat of the column of fluid present in the measuring tank 12. The pressure of the gas above the liquid surfaces in the container 10 is in that identical to the pressure of the external air where the sensor 151, which operates as a relative pressure sensor with external pressure reference, is located. From the knowledge of the nominal density d of the considered fluid, the controller deduces the height h of the column and therefore the fluid level according to the following well-known equation:

$$h=(1/g)*P\text{stat}/d$$

in which g is the gravity acceleration.

Figure 5:
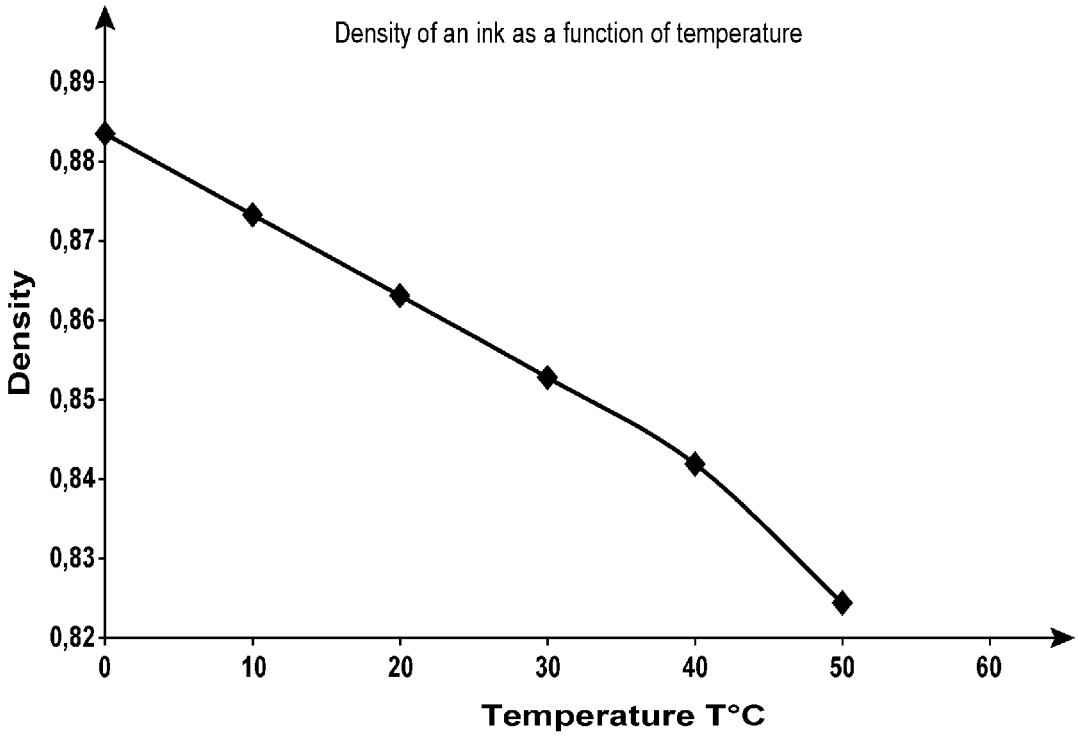
FIG. 5 shows the evolution of ink density as a function of temperature for a given ink adapted to be used in a printer according to the invention.

Depending of the ink type, the density may vary slightly as a function of the temperature as shown on FIG. 5 for a given ink adapted to be used in a printer according to the invention. Consequently, in order to improve the precision of the measured level, the density d may be determined as a function of the taken temperature, at the instant of the measurement.

Periodically, the sensor 151 is calibrated: the offset of the sensor, which determines the zero level, is measured after complete emptying of the measuring tank 12, i.e. after emptying to below the level of the opening of the tube 150. The complete emptying of the measuring tank 12 is done as follows:

- the solenoid valve 32 is switched to position NO (2-3), which connects the bottom of the measuring tank 12 with the inlet of the ink transfer pump 31 (hydraulic line L10);
- the solenoid valve 33 is switched to position NO (2-3), which connects the outlet of the ink transfer pump 31 with the bottom of the intermediate tank 11 (right part of line L1);
- the ink transfer pump 31 is activated and a cyclical level measurement is done until the low level of the measuring tank 12 is reached.

The utility functions of the fluid circuit or in other words, the functions of the measuring system are performed, as desired, by the controller of the printer.

For the measuring functions of the quantity of ink and the viscosity, the flow of the ink transfer pump 31 is essentially more significant than the flow of ink coming from the constant level tank 13 toward the measuring tank 12 through the line L3.

Measuring the Quantity of Ink Remaining the Container and Critical Levels Test:

After calibration of the continuous level sensor 15 (as previously described), the measuring tank 12 and the intermediate tank 11 are hydraulically connected by their bottom by switching the solenoid valve 33 into position NC (1-2). The ink withdrawn at the outlet of the ink pressurizing pump 20 is directed toward the intermediate tank (solenoid valve 18 in position NO (2-3)).

As the constant level tank 13 is continuously connected with the measuring tank 12, through the calibrated hydraulic restrictor 17 by the line L3, the levels of the volumes considered in the tanks 11, 12, 13 tend, after equilibrium, toward a single value (height H illustrated in FIG. 2) which is measured by the sensor 15. Knowing the area of the sections of the three tanks 11, 12, 13, the controller deduces the exact volume of ink available; this is ink ready for printing, i.e. of suitable quality (viscosity).

Comparing this level with predetermined thresholds also allows the controller to manage critical levels:

- exceeding a level having a risk of overflowing the container 10;
- passage below a level authorizing the replenishment of ink, by transfer of the new ink from the ink cartridge 30, without risk of overflowing the intermediate tank 11;
- passage below a low level which requires stopping of the consumption of ink (printing) to avoid the ingestion of air by the head through the ink pressure circuit.

Measuring Viscosity of the Ink Intended, to be Pressurized and to Supply the Head 1

The function is performed from the measurement of the time needed for a volume of ink, defined between two predetermined values provided by the level sensor 15, coming from the constant level tank 13 (constant charge) to flow through the calibrated hydraulic restrictor 17. This measured time is connected to the viscosity of the ink using characteristic curves previously established with the same measurement protocol for each type of ink and over the entire temperature range of use.

The controller first controls the positioning of the solenoid valve 18 in position NC (2-1), so that the constant level tank 13 is continuously supplied with the ink withdrawn at the outlet of the ink pressurizing pump 20.

After emptying the measuring tank 12 and isolating it from to the intermediate tank 11 (stopping of the pump 31, solenoid valve 33 in position NO (2-3)), the measuring tank 12 fills by the flow through the line L3 provided with the calibrated hydraulic restrictor 17. The time is measured between the passages of the level in the measuring tank by two values determining a given volume, this flow time duration being representative of the viscosity at a given temperature.

Control of the Addition of Solvent to Adjust Viscosity.

Thanks to the functions mentioned above knowing the exact volume and the viscosity of the ink contained in the container 10, measured using the functions described above, the controller can calculate the viscosity gap between the measured value and a setting value determined previously in an experimental way at the same temperature than the one of the measure and thus can determine precisely, in case of viscosity too low, the quantity of solvent to add in order to regain the nominal viscosity, from characteristics connecting the dilution level of the ink and its viscosity or a parameter representative of its viscosity.

These characteristics are determined beforehand for each type of ink and stored in the printer.

The quantity of solvent to add is converted into difference between levels in the measuring tank 12, taking into account if necessary the influency of the blend density on the level measurement, as explained above. Depending on the filling state of the solvent cartridge 40 (not empty or empty), solvent serving to correct the viscosity can be brought either from the solvent cartridge 40 or from the solvent tank 14:

- if the solvent cartridge 40 is not empty: the cartridge is connected to the inlet of the solvent transfer pump 41 (solenoid valve 42 in position NC (2-1)) and the solenoid valve 43 is closed.

When the pump 41 is turned on, it delivers in the solvent tank 14. Once this is full, it overflows into the measuring tank 12, the measured level of which one ensures beforehand is not null.

- if the solvent cartridge 40 is empty or absent, the solvent tank 14 is connected to the inlet of the solvent transfer pump 41 (solenoid valve 42 in position NO (2-3)) and the solenoid valve 43 is open. When the solvent transfer pump 41 is turned on, it delivers in part in the solvent tank 14 and in part in the measuring tank 12 (solenoid valve 43 open).

Whatever the case may be, the controller then begins the cyclical measurement of the level of solvent added until the desired solvent level is obtained. The level is corrected by deducing the quantity of ink continuously brought from the constant level tank 13.

The measuring tank 12 is then emptied into the intermediate tank 11.

Mixing of the ink by ink recycling through the solenoid valve 18 in position NO (2-3) allows homogenization of the viscosity. More precisely, the solenoid valve 18 is in position NO (2-3), the pump 20 is turned on, the ink coming from the intermediate tank 11 is withdrawn by the ink pressurizing pump 20 and redirected toward this same intermediate tank 11 to contribute to the homogenization of the ink by mixing.

Test for the Presence of a New Non-Empty Ink Cartridge 30:

This test is done in three steps:

1/the controller launches a first measurement of the volume of ink in the tanks 11, 12 and 13, as described above, 2/a small quantity of ink is withdrawn in the cartridge 30 using the ink transfer pump 31 (solenoid valve 32 in position NC (2-1)) and is directed toward the intermediate tank 11 (solenoid valve 33 switched to position NO (2-3), which cuts the hydraulic line L1 between the measuring tank 12 and the intermediate tank 11), 3/the solenoid valve 33 is again switched into position NC (2-1) to balance the three tanks, and a second measurement of the volume of ink therein is done as described above.

The comparison with the first measurement then makes it possible to see whether there is a difference in ink volume. Thus, if this difference exists, the ink transfer was indeed effective and this confirms the presence of a non-empty ink cartridge 30 connected to the fluid circuit. In the event no difference is observed, the ink cartridge 30 is empty or absent.

Control of the Transfer of Ink Between Cartridge and Intermediate Tank:

When the level in the container 10 allows it and a new ink cartridge is present (its maximum content is assumed to be known), the controller can decide to transfer the content of the ink cartridge into the tank. The transfer takes place in several times with monitoring of the level in the tank upon each transfer in order to avoid overflow into the main tank 10.

Steps 2 and 3 of the preceding function are linked several times with, in step 2, a more significant quantity of ink in order to limit the number of transfers.

The process continues until the level of the tank no longer evolves: the cartridge is then transferred completely or until the level exceeds a safety value, in this case the capacity of the cartridge is not as expected.

Test of Complete Emptying of the Solvent Cartridge 40:

This test is performed when adding of solvent designed to correct the viscosity of the ink.

As mentioned above, an addition of solvent from the cartridge 40 leads to filling the solvent tank 14 until it overflows into the measuring tank 12 in which the level variation is measured. If this variation is not observed, the solvent cartridge 40 is empty.

A change of solvent cartridge automatically resets the situation once an addition of solvent is requested from a new cartridge.

Pressurization of the Solvent for Rinsing of the Head During Stops and Starts of the Jet:

As mentioned above, the need to supply the head with pressurized solvent only occurs during the stops and starts of the jet, typically one to two times per day.

The diaphragm pump 41 is used to pressurize the solvent only during these stops/starts of the jet.

For this operation, the solvent is always taken from the solvent tank 14 (solenoid valve 42 in position NO (2-3)), which is refilled at the next addition of solvent to correct the viscosity.

The performance of the pump 41 chosen is such that:

- it provides pressure in the same order as that which the ink must have at the head in order to print (approximately 2 to 3 bars);
- it delivers a necessary flow to recycle the solvent in the solvent tank 14 through the restrictor 45;
- it delivers a sufficient flow to emit a jet through the nozzle of the generator 2.

However, as known by the inventors, this type of diaphragm pump generates very significant pressure undulations, typically around 1 bar. The inventors thus considered that, without a particular device, these pressure variations would cause harmful instabilities of the jet(s). Thus, the inventors defined a simple damping device implemented as follows.

Prior to pressurizing the solvent and outside the solvent transfer operation, the solenoid valve 43 is opened for a sufficiently long time for the cavity 46 to empty by gravity toward the solvent tank 14 through the calibrated hydraulic restrictor 45.

Once the solenoid valve 43 is closed, the air bubble in the cavity 46 remains in the solvent circuit downstream from the solvent transfer pump 41.

When the pump 41 is turned on, the solvent-head solenoid valve 6 is first not open: the excessive pressure undulations generated by the diaphragm pump 41 are damped by the damping device constituted by the air bubble associated with the restrictor 45.

When the pressure has stabilized after a certain time, the pressurized solvent can be used during stop/start sequencings. Indeed, the performances are sufficient to obtain a directive and stable jet of solvent at the opening of the solvent-head solenoid valve 6.

Using the described system, it is possible using the controller 200 to:

- determine the precise volume of ink available VE(t), in real-time, in the printer taking into account the ink present in the main tank and the new ink of the external cartridge 30. As previously mentioned, the management of the ink done by the controller is such that the external cartridge 30 is transferred entirely into the intermediate tank 11 once the available volume therein is at least equal to the standard volume of a cartridge 30. In the event a partially emptied cartridge is used, the total volume of ink calculated can be erroneous but the situation corrects itself once the cartridge is transferred by a precise measurement of the ink present in the tank. This is done without risk of breaking the supply of ink to the head because the transfer of the external cartridge is triggered while there is still a minimal amount of ink available, typically 150 cc.
- determine the exact average volume of a drop of printed ink to correct the theoretical volume of the evaluated drop with the nominal theoretical dimensioning of the jet (nozzle diameter, jet speed and drop frequency) by measuring the volume of ink consumed over a controlled period of the printing of a message having a known number of drops, prior to production.
- determine the average volume of solvent CSm(t) consumed over a sliding period T of time in order to adjust the quality of the ink, in the presence or absence of a solvent cartridge 40;
- determine the volume of solvent available VS(t), in real-time, in the internal solvent tank 14. This volume is maximum as long as the external solvent cartridge 30 is not empty. In the contrary case, its value is calculated by deducing the precisely measured volumes of solvent used to correct the quality of the ink and the known volumes of solvent used to clean the head. The latter are generally non-existent during a production session.

The controller 200 is constituted by an electronic board (material) and an embedded software. The electronic board brings together electronic interfaces making it possible, in particular, to activate the actuators of the head and the ink circuit 100 from software controls and to provide the latter with usable data coming from the sensors or detectors. The electronic board also comprises a micro-processor connected to the usual peripherals (RAM, PROM, I/O . . . ) allowing implementation of the embedded software. This carries out, in particular, the various processing and sequencings which were explained above.

The controller 200 is adapted to calculate the average consumption of ink used to print, over a fixed period T. To do this, the controller comprises an electronic counter making it possible to count the drops actually deflected for printing during the period T and, knowing the volume of a drop, the controller can then calculate the corresponding average consumption. The frequency of drop formation, which can be temporarily equal to the frequency of printed drops, is too high (around 100 kHz) to be processed by software without costly oversizing of the processor. The controller is therefore provided with a hardware counter supplied with signals coming from the charge amplifier driving the charge electrode 7 of the head. When the charge voltage is greater than a value below which deflection does not allow the drops to come out of the gutter 3, a signal is sent to the counter to increment its value.

The counter has a limited capacity: thus it is preferably provided to consult its value and reinitialize it at a period fixed by the processor of the board with a slow rate. In order to obtain counting of drops deflected during very long periods T, the processor accumulates the successive values from the counter.

Advantageously, the controller also uses the counter to detect abnormally long printing stops caused, for example, by production line stops, in order not to take them into account in the ink consumption average and to keep a consistent value when production resumes.

With the different available data, the controller can calculate the ink autonomy.

Figure 3:
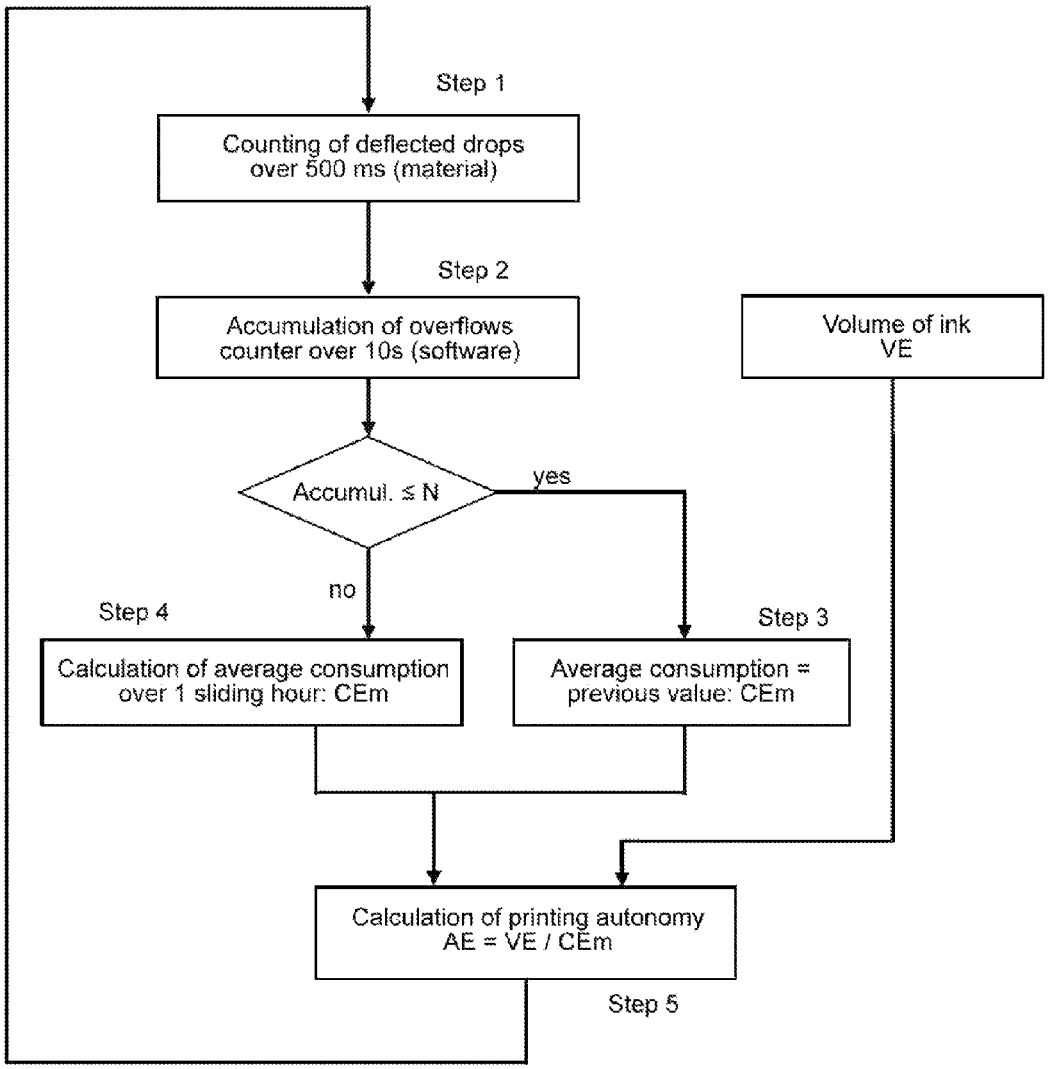
FIG. 3 shows a flowchart of the process for determining the printing autonomy for ink according to the invention.

The flowchart of FIG. 3 explains the progress of the operations. The durations of periods used in the chart are for information only and can be adapted without going beyond the scope of the invention.

After hardware counting of drops deviated over a period of 500 ms in step 1, in step 2, a number of printed drops are accumulated over a period T of 10 s. If this value is less than or equal to a threshold N which can be null, one considers in step 3 that the printing is stopped and the average consumption previously calculated is kept. On the contrary, if the value is greater than the limit, the sliding average consumption CEm over one hour is updated in step 4 taking the volume of the drops into account. Knowing the volume of ink VE available in the printer at that moment, in step 5 the ink autonomy is calculated: AE=VE/CEm.

The controller can also calculate the solvent autonomy AS with the minimum guaranteed volume of solvent available in the printer VS at that moment and the average solvent consumption CSm calculated continuously over a period: AS=VS/CSm.

Figure 4:
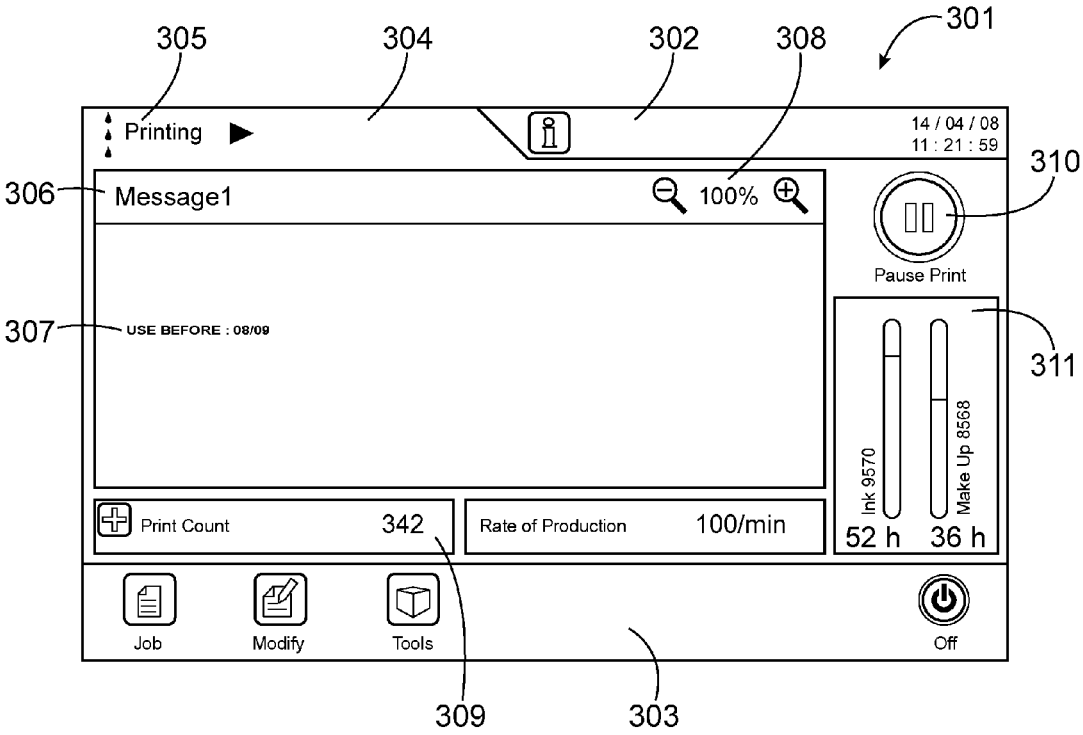
FIG. 4 is a reproduction of a screen as a component of the operator interface of the printer according to the invention, the screen visually showing the ink and solvent autonomy.

In FIG. 4 we have shown a reproduction of an LCD (Liquid Crystal Display) screen as a component of the operator interface according to the invention.

The LCD screen is preferably provided with a tactile surface allowing the operator to interact with the printer by manually selecting graphic objects appearing on the screen associated with commands or by drag-and-drop of graphic elements to position them in a given graphic context with the aim of editing messages to be printed or assigning a parameter to a command, for example.

The screen 301 according to the invention is constituted by several windows synthetically providing the main information useful to the operator concerning printing in the production session in progress. Thus, it includes:

- an upper band of information 302 with the time and date displayed on different colored backgrounds depending on the type of information: comments in white, warnings in orange or problems in red can also appear;
- a lower band 303 containing the buttons providing access to the configuration screens and a start/stop button for the printer;
- the majority of the screen is constituted by a zone 304 in tab form whereof the background is green during printing and grey when printing is stopped (visible from far away). In this tab, one finds the main elements concerning the printing in progress:
- the print status 305 with an animated logo, during printing, at the frequency of the messages, the name of the message 306 selected for printing, an preview 307 of the message with the magnification 308 indicated, a user-configurable space 309 providing real-time information on the production in progress. For example, a printed products counter, the rate . . . , a start/stop button 310 for the printing, a window 311 synthesizing, in real-time, the information concerning the consumables where one finds, for the ink and solvent, the commercial reference, a bar graph indicating the level of consumable fluids available in the printer and the autonomy in terms of hours of use (printing for ink, printer with operating jet for the solvent) from ink and solvent autonomy values obtained as previously described. This window could display the ink autonomy in number of printed products.

The invention claimed is:

1. A system for determining autonomy in consumable fluids of a continuous inkjet printer provided with a printing head, the system comprising:

a system for measuring a quantity of ink comprising a first tank having a first section extending over a height of the first tank and adapted to be filled with ink and to supply the printing head with pressurized ink therefrom and to respectively recover fluids coming from the head and not used for printing;

a second tank having a second section extending over a height of the second tank and a bottom of which being hydraulically connected with a bottom of the first tank by a first hydraulic line comprising a first valve, the second tank comprising a level sensor adapted to detect a height of a liquid in the second tank, a gas pressure of inside portions of the first and second tanks being at a same gas pressure;

means for establishing a forced hydraulic communication in ink from a removable ink cartridge, which the system is adapted to receive, and the second tank, respectively, toward the first tank to completely empty the second tank and the ink cartridge when a removable ink cartridge is installed in the system and provided in liquid communication with said first and second tanks;

control means adapted to perform opening of the first valve when the complete emptying of the second tank is done, to establish a filling of identical height by a communicating vessel between the first and second tanks; and calculating means adapted to determine a total volume of ink contained in the first tank and in the second tank from detection of the identical height by the level sensor and first and second sections;

a system for determining an average ink consumption comprising means for determining a volume of a drop coming from a jet emitted by the head;

an electronic counter connected to a charge electrode of the head to count, by comparison with a charge voltage applied to the charge electrode, a number of drops deflected by deflection electrodes of the head;

digital means for accumulating values counted by the counter over a period of time; and said calculating means determining an average ink consumption by multiplication of the number of drops counted over the period of time and the volume of a drop; and said calculating means determining an ink autonomy by division of a volume of ink with the average ink consumption.

2. The system for determining the autonomy in consumable fluids according to claim 1, in which the measuring system further comprises:

a third tank having a third section extending over a height of the third tank, the third tank being connected to the first tank by a second hydraulic line to establish a forced hydraulic communication from the first tank toward the third tank and comprising a second valve, a bottom of the third tank being in continuous hydraulic connection with the bottom of the second tank by a third hydraulic line comprising a calibrated hydraulic restrictor, the third tank also being constructed to overflow over the first tank; and means for establishing a forced hydraulic connection from the first tank toward the third tank.

3. The system for determining the autonomy in consumable fluids according to claim 2, wherein the control means is adapted to successively perform opening of the second valve during a forced hydraulic communication from the first tank toward the third tank until a constant level is established in the latter by overflowing into the first tank and closing of the second valve, when the complete emptying of the second tank is done and the constant level is established in the third tank, to establish filling of identical height by communicating vessel between the first, second, and third tanks, and to establish a flow of ink at constant pressure through the calibrated hydraulic restrictor.

4. The system for determining the autonomy in consumable fluids according to claim 2, wherein said calculating means of the measuring system is adapted to determine a volume of ink contained in the three tanks from the detection of the identical height by the level sensor and of the first, second, and third sections, and a viscosity of the ink, from evolution, as a function of time, of the level measured by the level sensor when the ink at constant pressure flows through the calibrated hydraulic restrictor, the measuring system thus also forming a viscometer for the ink for printing.

5. The system for determining the autonomy in consumable fluids according to claim 2, in which the measuring system further comprises:

a fourth tank having a fourth section extending over a height of the fourth tank and being adapted to be filled with solvent; and means for establishing a forced hydraulic communication from the fourth tank toward the second tank to bring solvent therein, in which the calculating means of the measuring system is also adapted to determine a height of solvent to bring into the second tank from knowledge of a calculated viscosity of the ink, in which the control means of the measuring system is adapted to interrupt arrival of solvent into the second tank by forced hydraulic communication, when the height of solvent is detected by the level sensor.

6. The system for determining the autonomy in consumable fluids according to claim 5, wherein said calculating means is configured to determine an average solvent consumption, by accumulation over a period of time, of volumes of solvent to correct the viscosity of the ink obtained by multiplying the height of the solvent brought into the second section of the second tank and by division of these volumes of solvent accumulated during the period, and a solvent autonomy by division of the volume of solvent contained in the fourth tank with the average solvent consumption.

7. A continuous inkjet printer comprising:

a system for determining an autonomy in consumable fluids according to claim 6; and a user interface adapted to visually display both ink autonomy and solvent autonomy in number of printing hours or number of remaining products to be printed for given printing conditions.

8. The system for determining the autonomy in consumable fluids according to claim 1, in which said control means, said calculating means, said electronic counter, and said digital means for accumulating values counted by said counter are integrated into a same controller.

9. The measuring system according to claim 1, wherein the level sensor is a continuous level sensor.

10. A system for determining autonomy in consumable fluids of a continuous inkjet printer provided with a printing head, the system comprising:

a system for measuring a quantity of ink comprising a first tank having a first section extending over a height of the first tank and adapted to be filled with ink and to supply the printing head with pressurized ink therefrom and to respectively recover fluids coming from the head and not used for printing;

a second tank having a second section extending over a height of the second tank and a bottom of which being hydraulically connected with a bottom of the first tank by a first hydraulic line comprising a first valve, the second tank comprising a level sensor adapted to detect a height of a liquid in the second tank, a gas pressure of inside portions of the first and second tanks being at a same gas pressure;

a first liquid transfer subassembly configured to establish a forced hydraulic communication in ink from a removable ink cartridge, which the system is adapted to received, and the second tank, respectively, toward the first tank to completely empty the second tank and the ink cartridge when a removable ink cartridge is installed in the system and provided in liquid communication with said first and second tanks;

a controller configured to open the first valve when the complete emptying of the second tank is done, and to establish a filling of identical height by a communicating vessel between the first and second tanks, wherein said controller is further configured to determine a total volume of ink contained in the first tank and in the second tank from detection of the identical height by the level sensor and first and second sections;

a system for determining an average ink consumption comprising said controller being further configured to determine a volume of a drop coming from a jet emitted by the head;

an electronic counter connected to a charge electrode of the head to count, by comparison with a charge voltage applied to the charge electrode, a number of drops deflected by deflection electrodes of the head;

said controller being configured to accumulate values counted by the counter over a period of time; and said controller being further configured to determine an average ink consumption by multiplication of the number of drops counted over the period of time and the volume of a drop; and wherein said controller is further configured to determine an ink autonomy by division of a volume of ink with the average ink consumption.

11. The system for determining the autonomy in consumable fluids according to claim 10, in which the measuring system further comprises:

a third tank having a third section extending over a height of the third tank, the third tank being connected to the first tank by a second hydraulic line to establish a forced hydraulic communication from the first tank toward the third tank and comprising a second valve, a bottom of the third tank being in continuous hydraulic connection with the bottom of the second tank by a third hydraulic line comprising a calibrated hydraulic restrictor, the third tank also being constructed to overflow over the first tank; and a driving subassembly comprising a pump, a valve, and a hydraulic line arranged to provide a forced hydraulic connection from the first tank toward the third tank.

12. The system for determining the autonomy in consumable fluids according to claim 11, in which the measuring system further comprises:

a fourth tank having a fourth section extending over a height of the fourth tank and being adapted to be filled with solvent; and a second liquid transfer subassembly configured to establish a forced hydraulic communication from the fourth tank toward the second tank to bring solvent therein, wherein said controller is further configured to determine a height of solvent to bring into the second tank from knowledge of a calculated viscosity of the ink, and wherein said controller is further configured to interrupt arrival of solvent into the second tank by forced hydraulic communication, when the height of solvent is detected by the level sensor.

* * * * *